US007137346B1

(12) United States Patent
Francke

(10) Patent No.: US 7,137,346 B1
(45) Date of Patent: Nov. 21, 2006

(54) LOCKING HINGE FOR UNSTAYED MAST DEPLOYMENT

(76) Inventor: Rafael Francke, 84 Cerro Crest Dr., Camarillo, CA (US) 93010

( * ) Notice: Subject to any disclaimer, the term of this patent is extended or adjusted under 35 U.S.C. 154(b) by 0 days.

(21) Appl. No.: 11/144,410

(22) Filed: Jun. 6, 2005

(51) Int. Cl.
*B63B 15/00* (2006.01)

(52) U.S. Cl. ..... 114/90; 114/91

(58) Field of Classification Search ..... 114/90, 114/91

See application file for complete search history.

(56) References Cited

U.S. PATENT DOCUMENTS 2,065,715 A * 12/1936 Leon ..... 114/90
3,527,840 A 9/1970 Price
4,016,823 A 4/1977 Davis
4,121,530 A 10/1978 Arce
4,453,482 A 6/1984 Barker
4,530,299 A * 7/1985 Ross ..... 114/39.14
4,700,649 A 10/1987 Schotz
4,914,783 A 4/1990 Jackson et al.

* cited by examiner

*Primary Examiner*—Stephen Avila
(74) *Attorney, Agent, or Firm*—J. E. Taggart

(57) ABSTRACT

Stepping and un-stepping of a sailboat mast, of the un-stayed type that is supported only by a receptacle configured in the sailboat structure, are facilitated by a hinged core that is easily retrofitted into the foot of the mast. The core includes a two-part locking hinge that, when the mast is elevated up out of the receptacle in process of stepping or un-stepping, serves to keep the mast upright with its base held aligned in location above the receptacle. Then the hinge, located at the foot of the mast, can be unlocked to allow the mast to be tilted down to any desired angle, where it can be easily removed. The system enables one crewmember to easily step or un-step the mast manually on sailboats up to about 30 feet in length, optionally assisted by a small lifting winch that can be rigged on board.

9 Claims, 4 Drawing Sheets

LOCKING HINGE FOR UNSTAYED MAST DEPLOYMENT

FIELD OF THE INVENTION

The present invention relates to the field of watercraft, and more particularly it relates to structure and method to facilitate the installation and removal of an un-stayed mast such as a sailboat mast of the type that is stepped in a mating receptacle built into the sailboat structure.

BACKGROUND OF THE INVENTION

As most commonly practiced, sailboat masts are designed to be held upright by a system of guy wires: typically a forestay, a backstay, and usually two or more pairs of lateral shrouds attached to the hull by chain plates. If the mast is stepped deep inside the hull, it may receive sufficient support part way up by a deck or cabin-top to hold the mast upright sufficient for maintenance work, e.g. for mast removal by a shore-based travel lift or crane, but not sufficient for sailing. Alternatively, in "tabernacle" mounting, the mast is stepped on the deck or cabin top, where a hinged attachment allows the mast to be lowered en route, e.g. to clear an overhead bridge, usually by inclining the mast forward. However, the "tabernacle" hinge generally cannot be made to hold the mast upright, even temporarily, without the necessary shrouds and stays.

In contrast to the stayed mast category as described above, in a special un-stayed mast category, addressed by the present invention, the sailboat and its mast are designed to sail without requiring any support from guy wires such as stays and shrouds.

As shown in FIG. 1 in a cross-sectional representation, an un-stayed mast 10 is held upright entirely by its lower end region being fitted in a cantilever manner into a strong receptacle 12 configured in the sailboat structure 14, usually in a deck or cabin top. The weight of the mast 10 rests on a support member or floor at the bottom of the receptacle 12, which will generally require drainage to prevent water accumulation.

The cross-sectional shape of the mast 10 and receptacle 12 is a matter of design choice and could include round, oval, rectangular or square. The mast 10 and receptacle 12 need not have identical cross-sectional shape, e.g. they could be circular and square, tangent at four places, and should be dimensioned for a slide fit so the mast 10 can be readily removed by pulling it upwardly and out of the receptacle 12.

A round cross sectional mast shape has the advantage that the mast 10 can be allowed to rotate for sailing purposes: annular sleeves or bearings may be placed near the upper and lower ends of the receptacle 12, and/or a ball or other form of thrust bearing may be deployed at the bottom to carry the weight of the mast 10.

Typically this category of cantilevered un-stayed rig has been viable for single-handed manual mast stepping and un-stepping only in small sailboats up to about 20 feet. With the sailboat underway in the water, or even docked, mast insertion or removal can be physically challenging, unwieldy and risky for one crewmember, since the foot of the mast 10 must be held steady and properly aligned with the receptacle 12 at the critical insertion/removal point otherwise the mast 10 and/or the receptacle 12 can be seriously damaged.

Since weight/strength characteristics of boats generally increase exponentially with boat length by the third power, the associated mast deployment difficulties would nearly double for a 25 foot boat, and more than triple for a 30 foot boat compared to a 20 foot boat; therefore in such larger boats, installing and removing un-stayed type masts manually becomes virtually impossible for one crew member and extremely difficult and skill-dependent even for two.

The capability of manually stepping and un-stepping of un-stayed masts is highly advantageous in avoiding the cost and inconvenience of hiring shore-based equipment such as a crane or travel-lift; however, with the conventional arrangement as shown in FIG. 1, manual stepping and un-stepping continue to prove troublesome, difficult or impractical, depending on the size of the sailboat and mast.

DISCUSSION OF KNOWN ART

U.S. Pat. No. 4,914,783 to Jackson et al discloses a SLIDING HINGE WITH LOCKING directed to aircraft nosecones or the like wherein a hinge connects an elongate cylindrical member to a shorter cylindrical slide arm which can be retracted along with the hinge into a tubular housing so as to hold the extending member in co-linear alignment with the retracted slide arm; from this condition, the slide arm can be slid to expose the hinge and thus allow the member to be then hinged to any desired angle.

U.S. Pat. Nos. 4,453,482, 4,700,649, 4,121,530, 4,016,823 and 3,527,840 disclose hinge structures for boat masts, however none of these provide a satisfactory solution to the problems in un-stayed masts of the type addressed by the present invention.

OBJECTS OF THE INVENTION

It is a primary object of the present invention to provide a method and associated structure for facilitating manual insertion and removal of a free-standing hollow sailboat mast of the type that is removably close-fitted at its lower end into a hollow holding receptacle built into the sailboat.

It is a further object to provide a device that provides alignment, guidance and damage protection for the lower end of the mast when inserting or removing the mast relative to the receptacle.

It is a further object to provide two main modes of mast retention: (1) a working mode wherein the mast is securely retained in a fixed substantially vertical disposition with its lower end inserted into the receptacle, and (2) a transitional mode wherein the mast, having been lifted out from the receptacle, remains engaged therewith in a manner that it can then be hinged at the lower end, tilted as desired and, if desired, easily disengaged and removed.

It is a further object that the added hinging device be fully enclosed within the lower end of the mast when the mast is in the working mode, i.e. inserted into the receptacle.

It is a further object that the invention can be easily retrofitted to a pre-existing sailboat with no modification required to the mast or its receptacle.

SUMMARY OF THE INVENTION

The above objects, including facilitating the stepping and un-stepping of a sailboat mast of the un-stayed type that is supported only by a receptacle configured in the sailboat structure, have been met by the present invention of a hinged-core system. Easily retrofitted into the foot of the mast, a free-standing core includes a two-part locking hinge that, when the mast is elevated up out of the receptacle in process of stepping or un-stepping, serves to keep the mast upright with its base held aligned in location above the receptacle. Then the hinge, located at the foot of the mast, can be unlocked to allow the mast to be tilted down to any desired angle, where it can be easily removed. The system enables one crewmember to easily step or un-step the mast manually on sailboats up to about 30 feet in length, optionally assisted by a small lifting winch that can be rigged on board.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
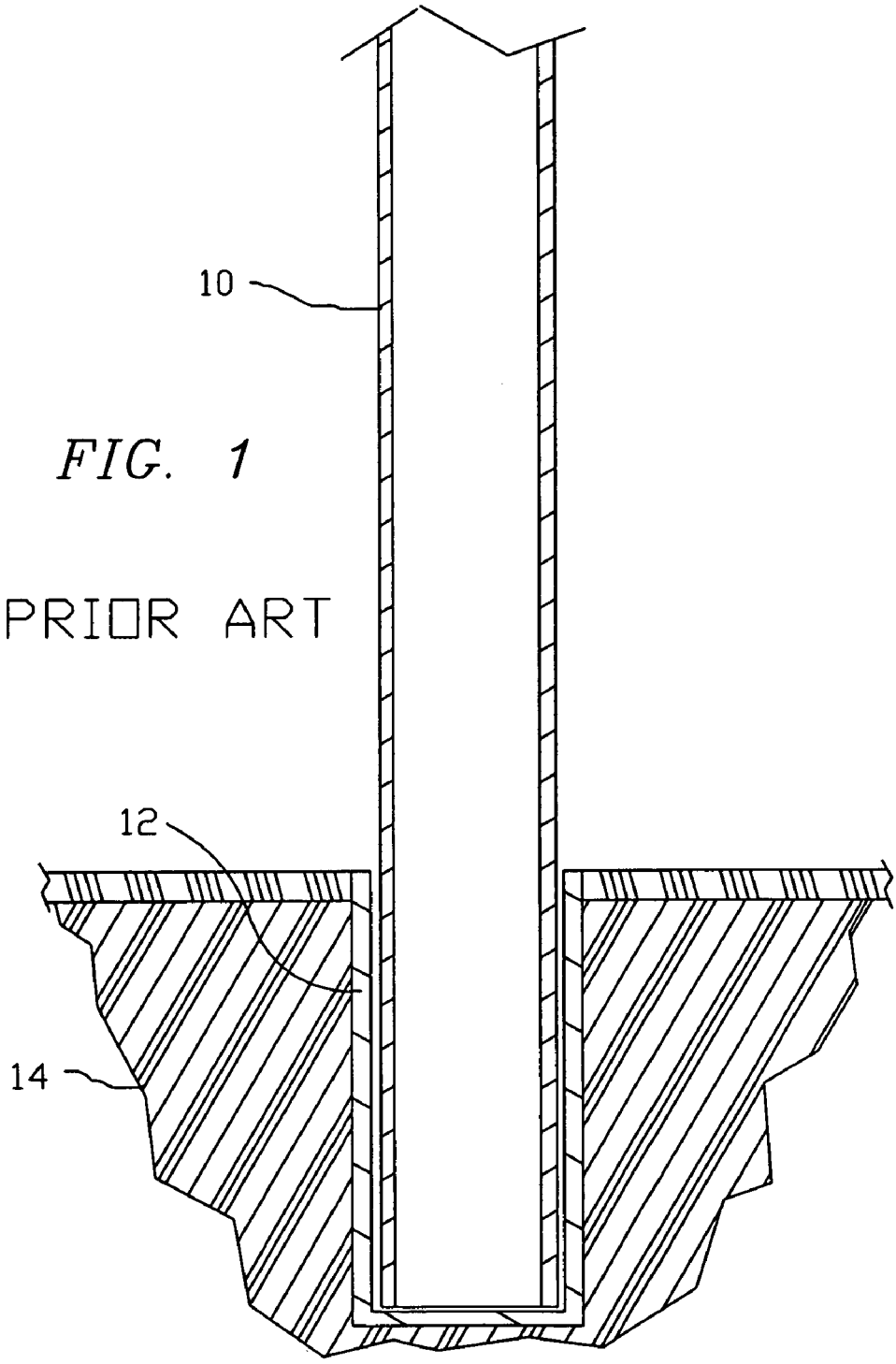
FIG. 1 PRIOR ART
FIG. 1 is a cross-sectional view representing an un-stayed mast of known art as described above.
Figure 2:
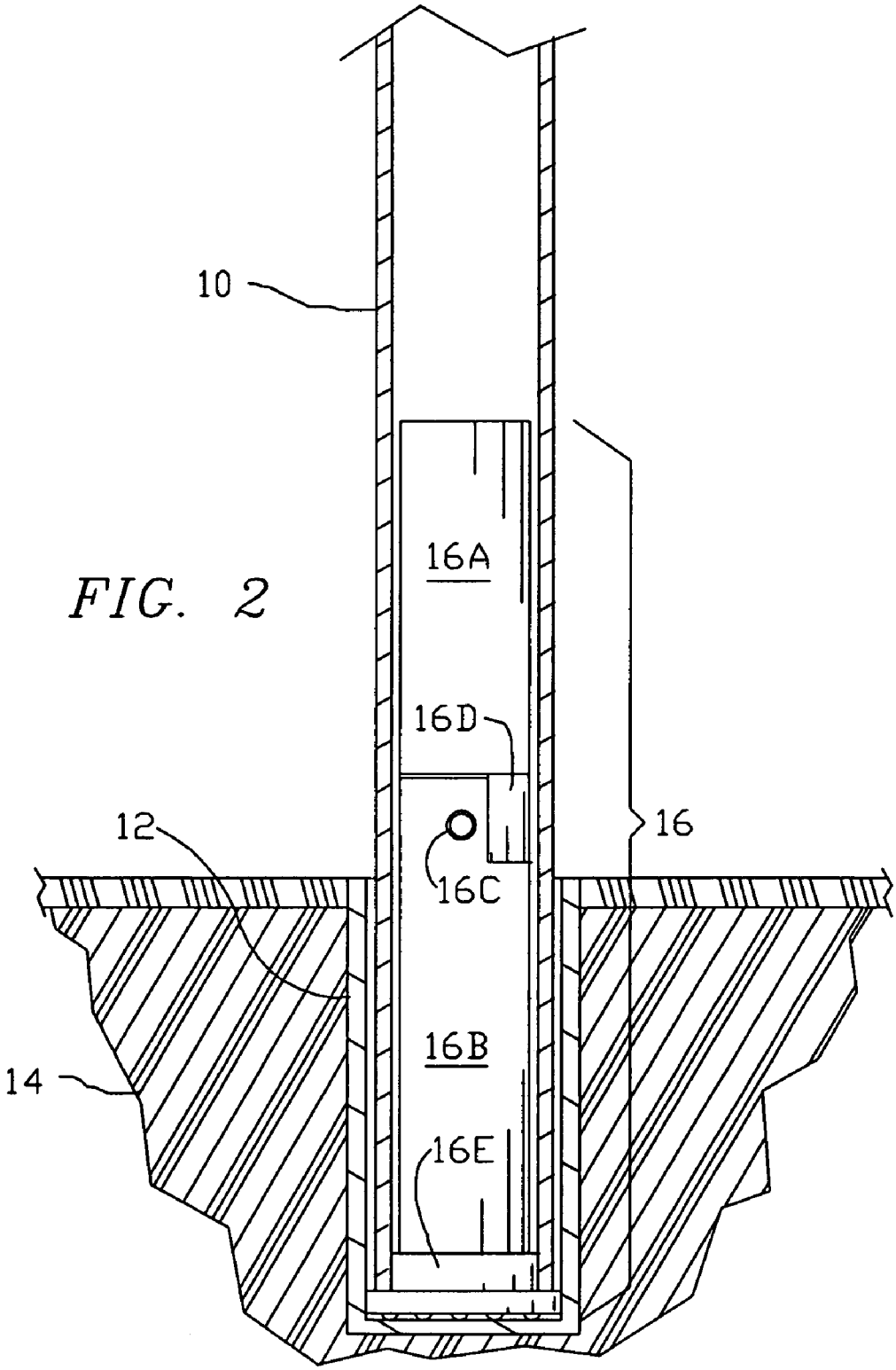
FIG. 2 is a cross-sectional view representing an un-stayed mast such as that of FIG. 1 in its normal working mode with the addition of a hinged core in accordance with the present invention, inserted into the receptacle and contained within the foot of the mast.

FIG. 2 shows a cross-sectional representation of mast 10 and receptacle 12 as described in connection with the known art arrangement of FIG. 1, but further fitted with the insertion of a lockable hinged core 16 of the present invention, shown in an elevational view. In this illustrative embodiment, mast 10, receptacle 12 and core 16 are circular in cross-section, thus core 16 is cylindrical in shape as shown. Core 16 is made up from two major portions: an upper hinge member 16A, extending upwardly into mast 10, and a lower hinge member 16B, the two members being pivotally attached together by hinge pin 16C, which is shown as a hollow tube, but which could alternatively be made solid.

In this working (i.e. sailing) mode, the two members of core 16 are prevented from pivoting: they are held collinear by a lock piece 16D interposed therebetween near hinge pin 16C and also by mast 10 closely surrounding the entire core 16 and thus holding lock piece 16D in place. Lock piece 16D is shaped in a partial tubular form to conform with lower hinge member 16B and may be sourced as a sector removed therefrom.

In this working mode, the mast 10 is held upright for sailing in the known manner of FIG. 1 by the closely-fitting receptacle 12; the inserted core 16 serves no particular function in this working mode, i.e. during normal sailing. Stored in place in the foot of mast 10 with its two portions co-linear, and resting on a bottom bushing 16E which is configured to hold it centered, core 16 stands by ready for deployment in facilitating un-stepping and subsequent re-stepping of mast 10.

Figure 3:
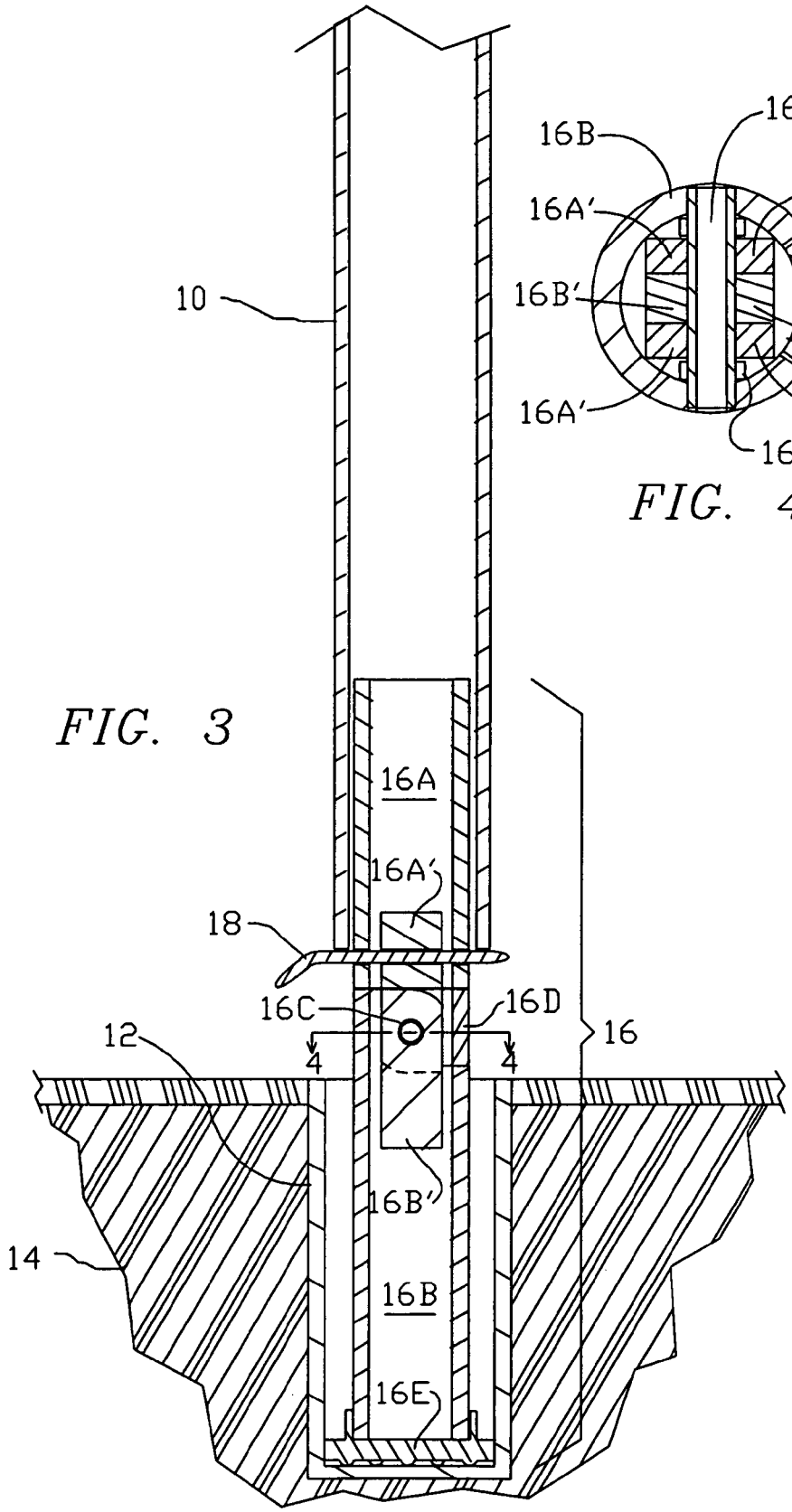
FIG. 3 shows the items of FIG. 2 with the mast raised up out of the receptacle but retained and stabilized by the hinged core, ready to be pivotally lowered and removed.

FIG. 3 is a cross-sectional representation of mast 10 and receptacle 12 of FIG. 2 after two steps in the procedure for de-stepping the mast for lowering and possibly removal.

The first step is elevating the mast to the extent shown so as to expose the central hinge portion of core 16

Figure 4:
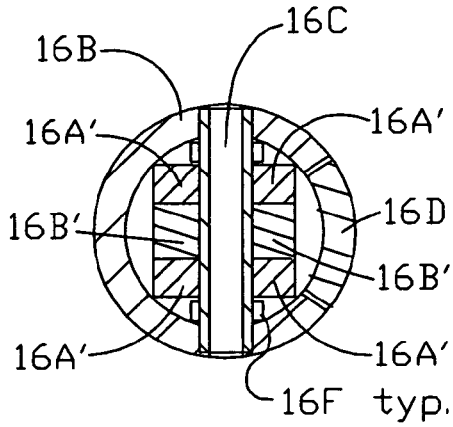
FIG. 4 shows an enlarged full cross-sectional view of the hinged core at 4—4 of FIG. 3.

FIG. 4 is an enlarged full cross-section taken at 4—4 of FIG. 3, showing a pair of cheek-blocks of upper hinge insert 16A', sandwiching the mating tongue of lower hinge insert 16B', traversed by hinge pin 16C, whose ends extend to the outer surface of the tubular shell of hinge member 16B. Hinge pin 16C is shown as hollow, i.e. tubular, which would allow a control bar to be inserted to control mast rotation as may be required during stepping/de-stepping on larger sailboats. Alternatively, hinge pin 16C could be made solid. Hinge pin 16C is held in place by a pair of clamps 16F, typically common stainless steel hose clamps, located as shown and each tightened in place by a screw.

In this embodiment, hinge members 16A and 16B are each fabricated in two pieces: a tubular shell and an insert made from solid square stock, dimensioned to contact the tubular shell at all four corners as shown, where hinge inserts 16A' and 16B' are fastened in place by screw hardware.

Alternatively, inserts 16A' and 16B' could be made cylindrical, i.e. circular instead of square in cross-section. As another alternative, hinge members 16A and 16B could be made integral including the corresponding inserts, by machining or casting; they could be made fully solid or configured with large cavities, e.g. to be substantially hollow, for weight reduction and material savings.

Referring again to FIG. 3, in the region of hinge pin 16C is a lock piece 16D, which may be a curved rectangular sleeve sector shaped as, or actually removed from, the tubular sleeve of lower hinge member 16B. Although lock piece 16D is held captivated in place by the mast 10 when it is stepped in its operational mode as in FIG. 2, such captivation is no longer in effect when mast 10 is elevated to expose the hinge, therefore lock piece 16D needs to be in held place by retaining hardware such as a screw or spring.

In the first step of elevating the mast 10 as in FIG. 3, the hinge portion becomes exposed, however the mast 10 remains held upright due to lock piece 16D acting as a compression block that prevents any hinge action, thus allowing the crewmember to proceed to the second step: inserting a support rod 18 through a passageway provided in the upper hinge member 16A as shown, and then letting the mast 10 move down to where its weight is supported on rod 18 as shown so that it is generally stable to stand alone.

At this stage, the gap left between core unit 16 and receptacle 12 when the mast 10 is elevated permits some "play" or "wobble" of the mast 10. This is generally negligible on smaller sailboats, however this can be overcome by inserting temporary spacers, such as two or three stabilizing wedges, down into the gap between core unit 16 and the upper opening of receptacle 12, during time periods when the mast 10 is elevated as shown.

Figure 5:
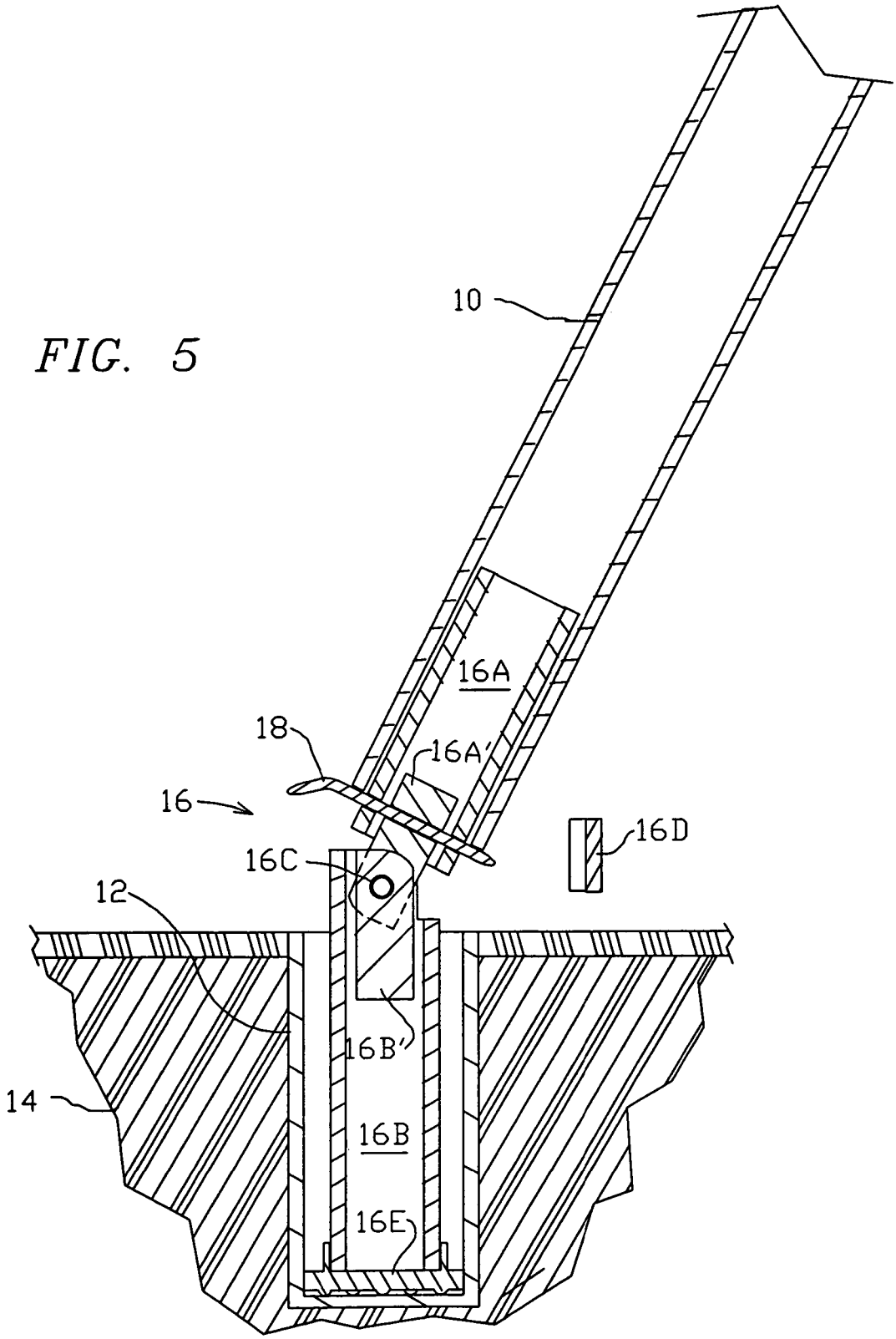
FIG. 5 shows the items in FIG. 3 with the mast inclined in process of being lowered while its lower end is held stable by the hinged core of the present invention.

FIG. 5 shows the items of FIG. 3 after removal of lock piece 16D has allowed the hinge 16 to pivot and allow the mast 10 to be manually inclined as shown and lowered to any desired angle, where, for removal, it may be readily pulled off from upper hinge member 16A.

To prevent misplacement or loss of lock piece 16D when removed as in FIG. 5, a form of tether or standby storage may be provided.

Re-stepping mast 10 is simply the reverse of the procedure described above. First, with mast 10 is slid onto the upper hinge member 16A as in FIG. 5 until it rests on support rod 18, the mast 10 is then raised manually to its full vertical upright position and lock piece 16D is replaced as in FIG. 3. Then support rod 18 is withdrawn and mast 18 is lowered manually into receptacle 12, guided by the cylindrical device 16, until it rests on the bottom of receptacle 12, typically via bushing 16E, thus reverting to the normal working mode shown in FIG. 2.

The invention may be practiced with hollow masts and receptacles of various cross-sectional shapes including circular, square, rectangular, elliptical or other oval shape.

Similarly the invention could be practiced with the hinged core configured in any of several cross-sectional shapes; it may be made solid, or partially hollow for weight reduction, from metal such as stainless steel or aluminum, or from robust plastic material.

As an option for larger sailboats, a small manual winch could be rigged to facilitate the step of elevating or lowering the mast 10 relative to its receptacle as described above, at times when the mast support pin 18 is not in place.

The mast support pin 16C may be made solid or tubular. In larger sailboats a tubular support pin 16 can accommodate a rod for holding the mast stable against rotation while stepping or un-stepping.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A mast-inserted hinged-core system for facilitating removal and re-stepping of an un-stayed hollow mast having a lower end stepped into a close-fitting mating receptacle having an open upper end, built into a horizontal region of a sailboat, comprising:

a lockable hinged-core, disposed and fitting closely inside a lower end of the mast, having a lower hinge member extending downwardly to a bottom panel of the receptacle and an upper hinge member extending upwardly into the lower end of the mast, the two hinge members being pivotedly attached by a hinge pin located above the horizontal region of the sailboat, and being retained in a mutually collinear relationship by the surrounding mast; and a lock piece of solid material fitting into an opening configured between the two hinge members, made and arranged to be captivated in place when surrounded by the mast, and to bear against the two hinge members in a manner to temporarily inhibit inter-pivoting thereof and to thus retain the collinear relationship even when, for purposes of stepping and un-stepping operations, the mast is elevated to a transitional condition wherein the lower end thereof is located a predetermined distance above the hinge pin with a substantial portion of the upper hinge member surrounded by a lower portion of the mast.

2. A mast-inserted hinged-core system for facilitating removal and re-stepping of an un-stayed hollow mast having a lower end stepped into a close-fitting mating receptacle having an open upper end, built into a horizontal region of a sailboat, comprising:

a lockable hinged-core, disposed and fitting closely inside a lower end of the mast, having a lower hinge member extending downwardly to a bottom panel of the receptacle and an upper hinge member extending upwardly into the lower end of the mast, the two hinge members being pivotedly attached by a hinge pin located above the horizontal region of the sailboat, and being retained in a mutually collinear relationship by the surrounding mast;

locking means made and arranged to temporarily inhibit inter-pivoting of the hinge members and to thus retain the collinear relationship even when, for purposes of stepping and un-stepping operations, the mast is elevated to a transitional condition wherein the lower end thereof is located a predetermined distance above the hinge pin with a substantial portion of the upper hinge member surrounded by a lower portion of the mast; and support means made and arranged to support the mast temporarily in the elevated transitional condition pending further operation in stepping and un-stepping operations.

3. The hinged-core system as defined in claim 2 wherein said support means comprises a support rod made and arranged to traverse a passageway configured through the upper hinge member in a lower region thereof located above the hinge pin such that the mast can be gravitationally supported by ends of said support rod extending out from the upper hinge member.

4. A method for deploying an un-stayed hollow sailboat mast of a type that is originally made to be stepped in a close-fitting tubular receptacle, with an open upper end, built into a horizontal surface region of a sailboat, wherein procedure for facilitating insertion of the mast into the receptacle comprises the steps of:

(1) inserting into the open upper end of the receptacle a lockable hinged-core, sized to fit closely inside a lower end of the mast and configured with (a) a lower hinge member, extending downwardly to a bottom support member of the receptacle and extending upwardly to a hinge point located above the horizontal surface region of the sailboat, (b) an upper hinge member extending upwardly from the lower hinge member and (c) a hinge pin traversing and attaching the two hinge pin members in a pivoted manner that enables the two hinge members to be set to a desired angle there between within a range from 180 degrees, i.e. collinear, to approximately 90 degrees, i.e. perpendicular;

(2) setting the upper hinge member to a desired angle relative to the lower hinge member;

(3) locating the mast with the lower end thereof located near the upper hinge member;

(4) aligning the mast with the upper hinge member:

(5) sliding the lower end of the mast onto the upper hinge member to an extent limited by temporary mast support means provided in the upper hinge member;

(6) pivoting the mast and the upper hinge member to an upright orientation collinear with the lower hinge member;

(7) inserting a lock block in a space configured between the lower hinge member and the upper hinge member in a manner to lock the hinged-core in the collinear condition and prevent further pivoting thereof;

(8) removing the temporary mast support means;

(9) guiding and allowing the mast to move downwardly so that the lower end thereof enters the receptacle and moves down to enclose the hinged-core and to rest on the bottom support member thereof.

5. The method for deploying an un-stayed tubular mast, as defined in claim 4 wherein the procedure for facilitating insertion of the mast into the receptacle comprises the further discretionary substeps of:

(1A) inserting temporary spacing means between the lower hinge member and the receptacle at its upper end to eliminate play and wobble there between and thus temporarily stabilize the mast relative to the receptacle; and (7A) removing said temporary spacing means.

6. The method for deploying an un-stayed tubular mast, as defined in claim 4 wherein the procedure for facilitating insertion of the mast into the receptacle comprises the further discretionary substep of:

(7A) removing any temporary spacing means found between the lower hinge member and the receptacle.

7. The method for deploying an un-stayed tubular mast, as defined in claim 4, wherein, after insertion of the mast as defined, procedure for lowering of the mast comprises the steps of:

(10) elevating the mast until the lower end thereof is located a predetermined distance above the hinge pin with a substantial portion of the upper hinge member surrounded by a lower portion of the mast;

(11) re-deploying the temporary mast support means;

(12) lowering the mast to rest on the mast support means;

(12) removing the lock block; and

(13) inclining the mast, as permitted by pivoting of the upper hinge member about the hinge pin, to a desired lowered location.

8. The method for deploying an un-stayed tubular mast, as defined in claim 6 wherein the procedure for procedure for lowering of the mast comprises the further discretionary substeps of:

(10A) inserting a temporary spacing means between the lower hinge member and the receptacle at its upper end to eliminate play and wobble there between and thus temporarily stabilize the mast relative to the receptacle.

9. The method for deploying an un-stayed tubular mast, as defined in claim 6, wherein, after lowering the mast as defined, removing the mast comprises the step of:

(14) moving the mast in a direction away from the upper hinge member so as to slide the lower end of the mast off the upper hinge member, thus effecting removal of the mast.

* * * * *